United States Patent [19]

Lieberman

[11] Patent Number: 4,991,877

[45] Date of Patent: Feb. 12, 1991

[54] DRUG INFORMATION COMMUNICATION SYSTEM EMPLOYING CARDS, ICONS AND A DISPLAY RACK WITH INTEGRAL INDEXING SYSTEM

[76] Inventor: Michael L. Lieberman, 301 E. 62nd St., New York City, N.Y. 10021

[21] Appl. No.: 475,978

[22] Filed: Jan. 31, 1990

[51] Int. Cl.[5] ..... B42D 15/00

[52] U.S. Cl. ..... 283/36; 283/62; 283/900

[58] Field of Search ..... 283/62, 900, 36, 37, 283/38, 39, 40, 41, 42, 43; 281/2, 5

[56] References Cited

U.S. PATENT DOCUMENTS

| | | | |
|---|---|---|---|
| 1,363,081 | 12/1920 | Brown | 283/62 |
| 3,497,982 | 3/1970 | Schulz | 283/900 |
| 3,517,449 | 6/1970 | Frandsen | 283/62 |
| 4,156,539 | 5/1979 | Davidson et al. | 283/900 |
| 4,221,404 | 9/1980 | Shuffstall | 283/900 |
| 4,460,824 | 7/1984 | Kadogaki | 283/900 |

*Primary Examiner*—Paul A. Bell

*Attorney, Agent, or Firm*—Mason, Fenwick & Lawrence

[57] ABSTRACT

A method and apparatus for educational information transfer to consumers of prescription medication using a greeting card-style format and unique icons to structure categories of drug information. Integral to the apparatus is a capsule-shaped, free-standing revolving floor rack holding 80 to 100 different cards.

7 Claims, 6 Drawing Sheets

73

| NAME OF DRUG | CARD |
|---|---|
| Acetaminophen/Codeine | 1 |
| Acyclovir | 29 |
| Albuterol | 43 |
| Allopurinol | 61 |
| Alprazolam | 24 |
| Amiloride/Hydrochlorothiaide | 68 |
| Amitriptyline | 32 |
| Ampicillin | 75 |
| Amoxycilin/Clavulante | 44 |

DRUG INFORMATION COMMUNICATION SYSTEM EMPLOYING CARDS, ICONS AND A DISPLAY RACK WITH INTEGRAL INDEXING SYSTEM

BACKGROUND OF THE INVENTION

1. Field of the invention

The present invention relates to consumer education, in general, and to a system for communicating drug information to consumers, including patients receiving prescription medications, in particular.

2. Description of the Prior Art

The use of printed matter as a means of the conveyance of drug information, in a format understandable by the lay person, has long been known. In general, this has been accomplished through published works, such as books, pamphlets, brochures and the like, encompassing a wide range of prescription and non-prescription drugs.

Persons reading or viewing these works are then able to understand the uses and caveats of various medications. Information thus imparted is generally divided into separate categories, such as, but not limited to, uses of the medication; conditions which would make use of the drug inappropriate; other medications which may interact with the drug; potential side effects of the drug; special cautions for certain age groups using the drug; proper dosing guidelines; and recommendations for storage.

SUMMARY OF THE INVENTION

The present invention relates to a method and apparatus for education and information transfer to consumers of prescription medications using a greeting card-style format and unique icons to structure catagories of drug information. Also included in the apparatus is a capsule-shaped, free-standing revolving floor rack holding 80 to 100 different cards.

The use of greeting cards has long played a significant role in ritual and expressions of thought and sentiment. The greeting card format has become familiar to most people, providing a comfortable framework for receiving messages. Unlike some recent technologies used to impart drug information, such as computer printouts or on-line computer information services, the format of the present invention is designed to educate consumers of prescription medication as to a drug's uses and precautions in a familiar context, through non-technical terms in a printed format, utilizing text and unique icons.

The present invention also makes use of icons to designate categories of drug information. The greeting card format is combined with the icons designating specific categories of drug information as a system for transferring drug information. This is all accomplished with the aid of a display rack to present the drug information using a simple index system, cross-referenced for all applicable brand and generic names of drugs included in this system.

It is thus an object of the present invention to effect the transfer of information to person taking prescription medication.

It is also an object of the present invention to incorporate the use of unique icons in delineating categories of drug information in a manner which simplifies the transfer of this information.

It is an additional object of the present invention to provide a means of user interaction whereby check-off boxes are provided next to certain key information as it applies to the person using this invention. In this way, the drug information card becomes a permanent written record of a user's experience with taking a prescription medication and serves as the basis for further discussion with a patient's doctor or pharmacist.

It is another object of the present invention to provide a unique card for each drug with the several cards integrated into a unified education system.

It is yet another object of the present invention to provide a unique indexing system making use of assigned numbers for each prescription drug card. An information band located across the top of the front face of the card makes it possible to quickly locate the correct card on the revolving display unit by first referring to an index running around the top of the revolving floor display.

This index includes the generic name of each drug, as well as any brand names. It is designed so that the user is directed to the number assigned to the proper drug information card no matter which drug name is known to the user.

These and other objects are accomplished by a method of information transfer of prescription drug information for use by persons desiring information about prescription medication.

BRIEF DESCRIPTION OF THE DRAWINGS

There are shown in the drawings the embodiments of the invention which are presently preferred. It should be understood, however, that the invention is not limited to the precise arrangements and instrumentalities depicted.

DETAILED DESCRIPTION OF THE PREFERRED EMBODIMENTS

The present invention involves a means of communication applicable to those desiring information about prescription drugs. People have been conditioned to respond in a positive manner to the concept of greeting cards. They are familiar with the booklet-type arrangement of the pages and they are receptive to information presented in this context.

Figure 1:
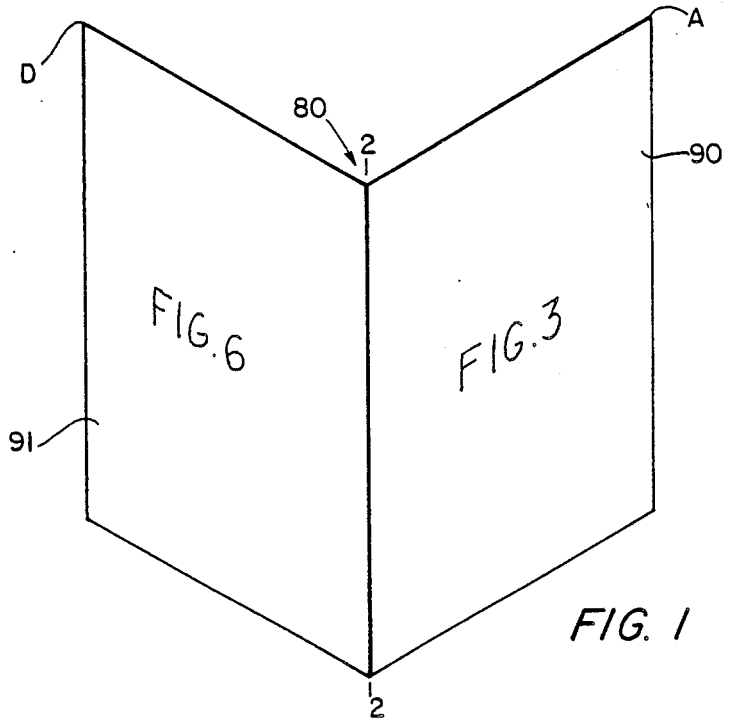
FIGS. 1 and 2 are perspective views of a drug information card according to the present invention. The illustrated card is made up of a flat planar sheet printed on both sides and folded along a center line.
Figure 2:
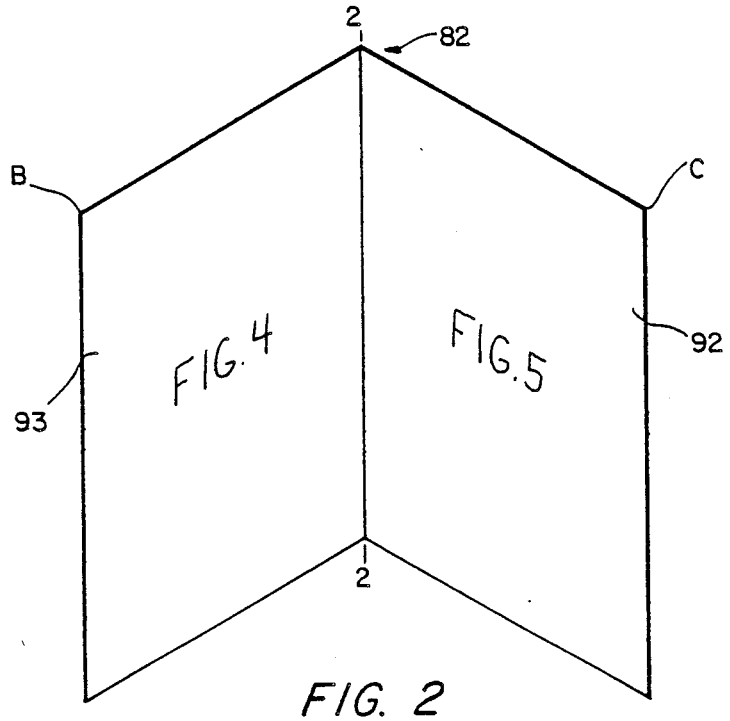

A preferred embodiment of the drug information card according to the present invention is shown in FIGS. 1 through 6. The card is constructed as a planar sheet folded along a center line 2 to form an outer face 80 (FIG. 1) and an inner face 82 (FIG. 2). Outer face 80 defines the front cover page A containing the FIG. 3 subject matter and the back cover D containing the FIG. 6 subject matter. Inner face 82 defines page B containing the FIG. 4 subject matter and page C containing the FIG. 5 subject matter.

Eye-readable information on the card includes text and pictorial depiction of unique icons 23 through 38. The present invention relies on the comfortable milieu established by the greeting card format to effectively convey drug information to consumers of prescription medication.

Figure 3:
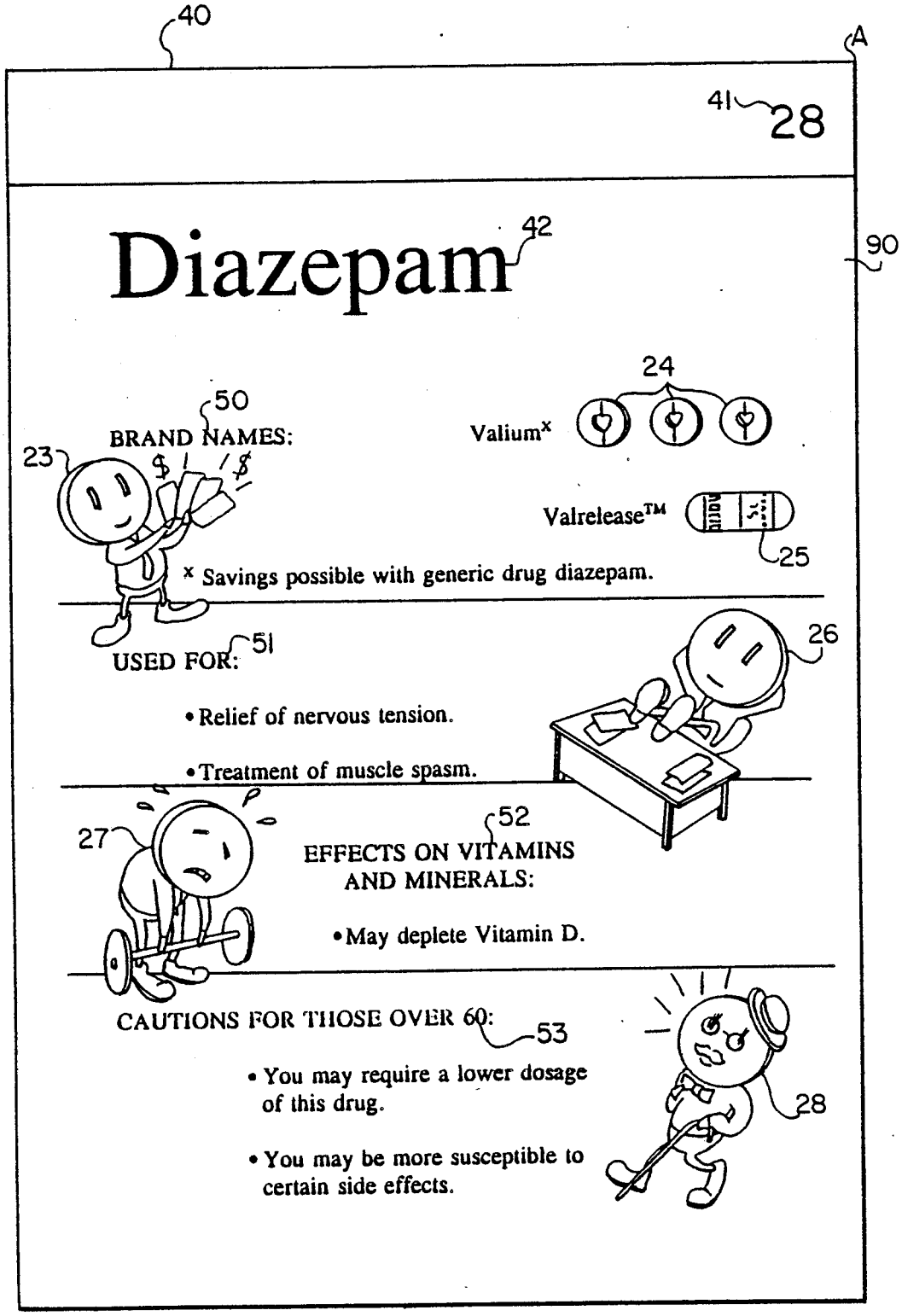
FIG. 3 is a front plan view of a portion of the drug information card of FIG. 1.

A theme running through this invention is a so-called "pillman" icon 23 and 26 through 38 depicted at various activities connoting different categories of drug information. In FIG. 3, an information band 40 running across the top of the card is shown in which the marketer of the invention can place an identifying logo and/or product name. In the same information band 40 to the extreme right is an identifying number 41. A different number is assigned to each of the 80 to 100 different cards included in a preferred embodiment of the invention. The different numbers 41 are also integral to the indexing system located on a card display rack 84 (FIG. 7) which allows a user of the present invention to quickly find the proper drug information card.

In FIG. 3, just below the information band 40, the name of the drug whose information is presented in that card appears and is identified by number 42. Printed preferably in prominent large type, the name of the drug 42 serves as the basis for easy user identification of the card.

In FIG. 3, the "brand names" section 50 appears just below the drug name 42 and displays the different proprietary names assigned to each drug. The location of this section is in keeping with the importance of this information in making sure the user has selected the correct card. Pictures of the different drug dosage forms available in the "brand names" sections 24 and 25 ar presented to give the user a comparison for easy drug identification and to confirm that the medication he is taking is the same as that for one of the illustrated drug types. The "pillman" icon 23, located to the left of the pictures 24 and 25 depicts him holding money to connote savings possible with generic drug use. When the drug is available generically at monetary savings, this is so indicated by the phrase "[S]avings possible with generic drug diazepam" 4. This phrase 4 mentions the name of the appropriate drug on each different card for which this phrase applies.

In FIG. 3, each drug's uses are presented under the "USED FOR" section 51. It is necessary that this vital information be located here so the user can be assured that the drug is being prescribed for an FDA-approved indication.

This category is depicted by the "pillman" sitting at repose with his feet up on a desk to the right of the text, contemplating the uses for the drug 26. Many drugs have more than one use and the most common ones are presented under this heading 51.

FIG. 3 shows the information category "EFFECTS ON VITAMINS AND MINERALS" 52 and is illustrated by "pillman," located to the left of the text, lifting exercise weights 27. This is meant to depict the effects that drug-induced vitamin or mineral deficiencies may exert on one's health and fitness.

This information category 53 is positioned on the front cover 90 of the drug information card in order to quickly catch the eye of any prospective purchaser. This information category 53 is also included as a selling point to retailers who may achieve a tie-in sale of a vitamin or mineral supplement through the sale of this card.

"CAUTIONS FOR THOSE OVER 60" years of age 53 are shown in FIG. 3 and are illustrated by an elderly "pillman" 28 walking with a cane and located to the right of the text 53. The placing of this information category on the front cover is done to quickly capture the attention of an elderly prospective purchaser.

Figure 4:
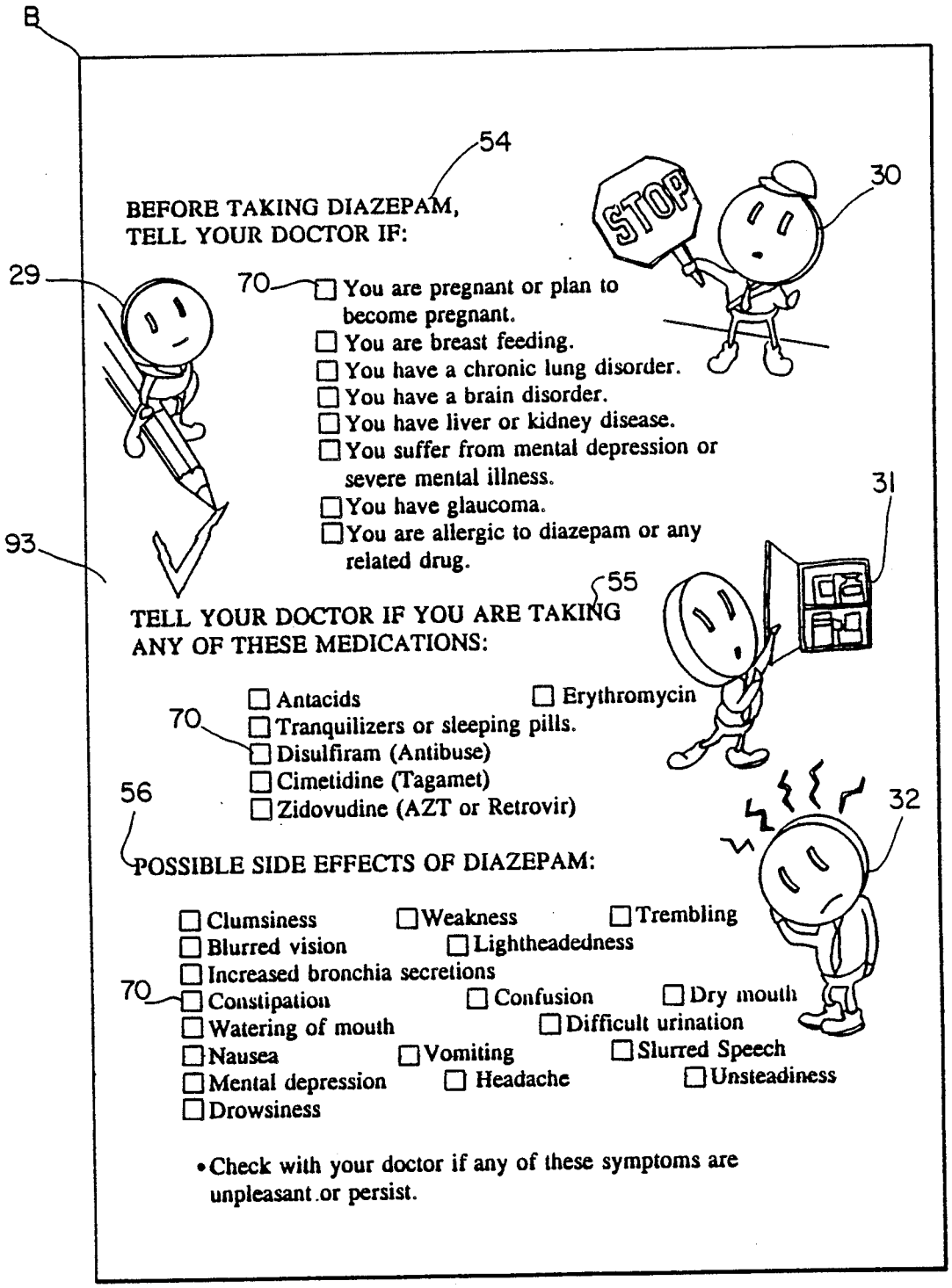
FIG. 4 is a plan view of an inner face of the drug information card of FIG. 2.

FIG. 4 illustrates the inside first or left page 93 of a drug information card and shows "pillman" 49 sitting on a pencil atop a check mark located to the right of the information presented in 54. User interactive check-off boxes 70 located to the left of all information on this page are designed as a unique feature of this invention. By penciling in a check mark in a box located next to any information which applies to the user, the drug information card becomes a permanent record of a patient's experience with a drug. This written record serves as the basis for later consultation with a physician or pharmacist. By dedicating this entire page 93 to active user participation, it is delineated and segregated physically from the other information in the card and offers easy referral to this information at a later date during professional consultation.

FIG. 4 shows the page 93 including a section 54 detailing any conditions a doctor should be made aware of before a person takes the drug which is the subject matter of the card. This is illustrated by "pillman" 30, located to the right of the text 54, holding a stop sign and dressed as a traffic crossing guard. This icon 30 connotes the need for the user of the present invention to pause and ponder whether any of the pre-existing conditions listed apply before taking the drug. Check-off boxes 70, located just below the title text 54, precede each listed item, encouraging active participation by the user of this invention.

"Pillman" 31 is peering into a medicine cabinet with a look of puzzlement at the right central portion of FIG. 4. Located to the right of the text 55, this icon is intended to convey the concept of unfamiliarity with other drugs the user of the present invention may be taking. With the prospect of one or more of these listed drugs being incompatible with the drug described on the drug information card, this section suggests that your doctor be made aware if any of this information 55 applies. Each listing is preceded by a handy check-off box 70 for user interaction.

Possible side effects from the use of the drug are presented at the bottom of the page 93 in an information category shown in FIG. 4 and represented graphically by "pillman" 32. Located to the right of the text 56, "pillman" 32 is depicted as suffering from dizziness, a condition occasionally experienced as a drug side effect. The side effects listed under this information category are the most common ones, as space limitations do not allow more complete elaboration.

Figure 5:
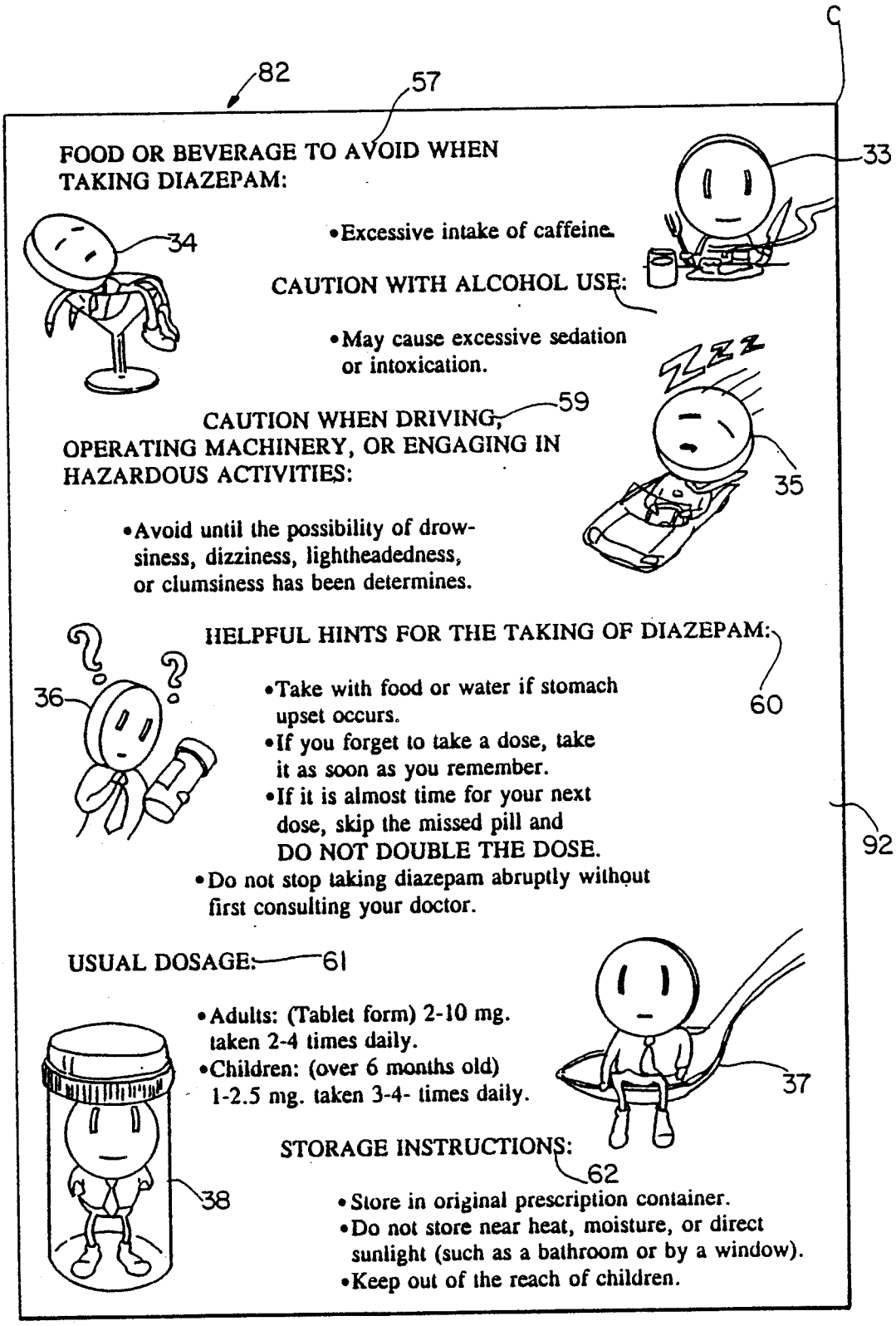
FIG. 5 is a plan view of an inner face of the drug information card of FIG. 2.

FIG. 5 illustrates the inside second or right page 92 of a drug information card and shows "pillman" 33 at the top of the card eating at a table. This icon, positioned to the right of the text 57, represents a category of information detailing foods or beverages to avoid when taking certain drugs.

Textual cautions 58 to be observed when simultaneously taking the drug and drinking alcohol are detailed in FIG. 5 just below the text 57. This is graphically depicted by "pillman" 34, located to the left of the text 58, falling asleep in a cocktail glass. This represents a common effect of alcohol, which is to cause drowsiness.

The advisability of taking each drug when driving, operating machinery or engaging in hazardous activities 59 is detailed by text 59 in FIG. 5 just below text 58. "Pillman" 35 shown to the right of the text, is depicted asleep at the wheel of an automobile. This represents the propensity of some medications to cause drowsiness.

Helpful hints for taking a medication are given by text 60 in FIG. 5 just below text 59 and represented graphically by "pillman" 36 staring in puzzlement at a prescription drug container. This icon, placed to the left of the text 60, is meant to depict the plight of many drug consumers who are unsure of when to take their medication, whether to take it before or after meals, or what to do if they miss a dose.

FIG. 5 depicts "pillman" 37 sitting on a teaspoon below text 60. Placed to the right of the text 61, this icon 37 graphically suggests the usual dosage for the drug. A teaspoon is a common implement used to administer liquid medication and its use in this illustration serves to reinforce this concept. Storage instructions for the medication are given by text 62 in FIG. 5 below the usual dosage text 61. This is illustrated by a picture of "pillman" 38, located to the left of the text 62, looking out from the inside of a prescription pill vial.

Figure 6:
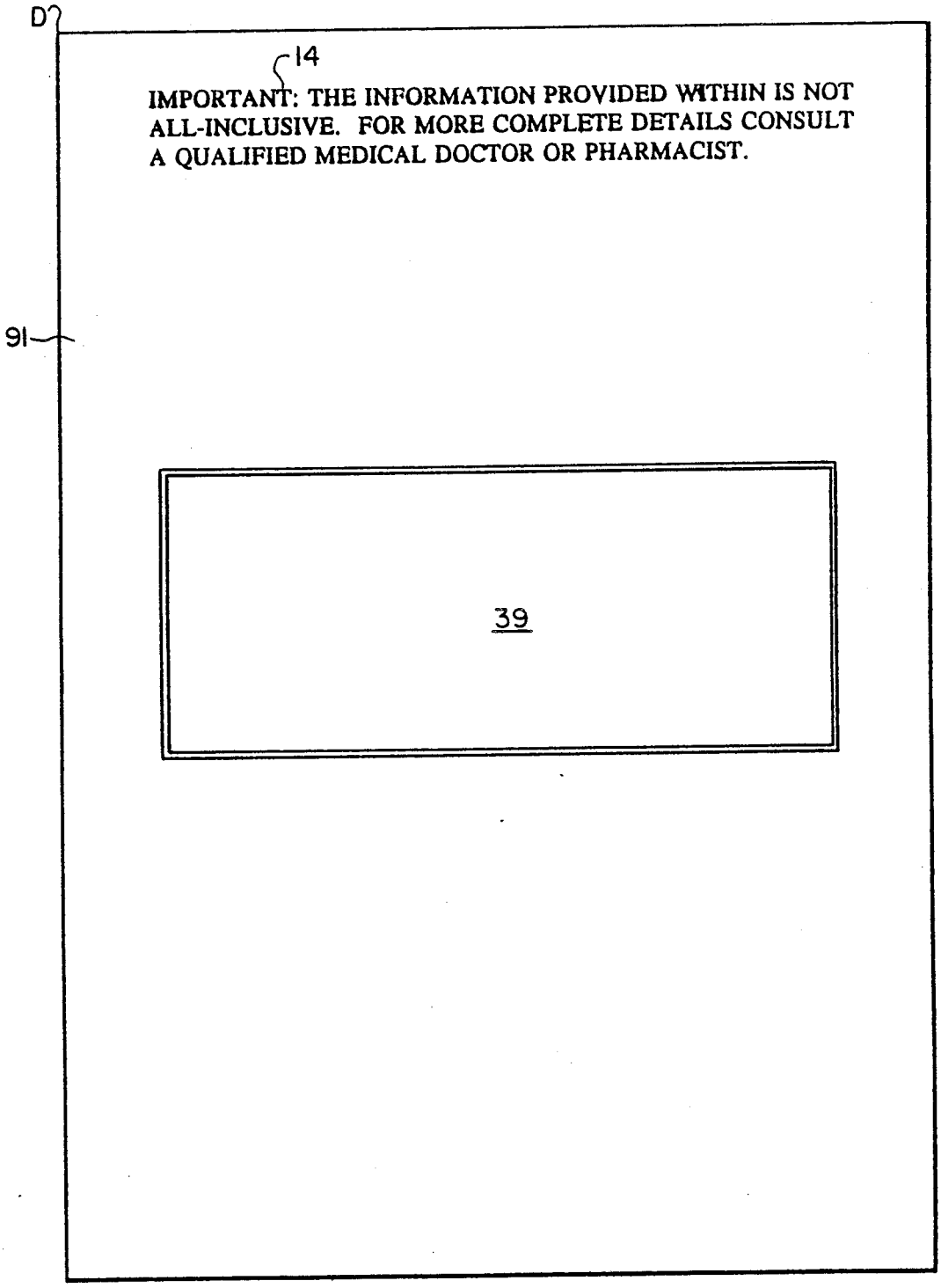
FIG. 6 is a plan view of the drug information card of FIG. 1.

FIG. 6 illustrates the outside back cover 91. A legal disclaimer is located at top of the cover 91 of the card 14 which is intended to remind users that the information imparted by this medium is not meant to be all-inclusive. It further states that more complete details should be sought from one's medical doctor or pharmacist.

FIG. 6 also includes a blank area enclosed by a rectangular border 39 and located slightly above the vertical center of cover 91 of the card. In this space 39, any pharmacy or other business selling the present invention can imprint its own name, address and telephone number with a rubber stamp or by any other means. This serves as promotion for the store, reminding patients where they purchased their prescription medication and also serves to promote a professional image for the pharmacy. As particularly applied to a greeting card format, information for the present invention is presented in easily understood, non-technical language with unique "pillman" icons 23 and 26 through 38 symbolizing different categories of drug information. These icons can function to either take the reader sequentially through the information presented in this invention or to draw the eye naturally to the symbolic representation of any desired information category.

Figures 7, 7A:
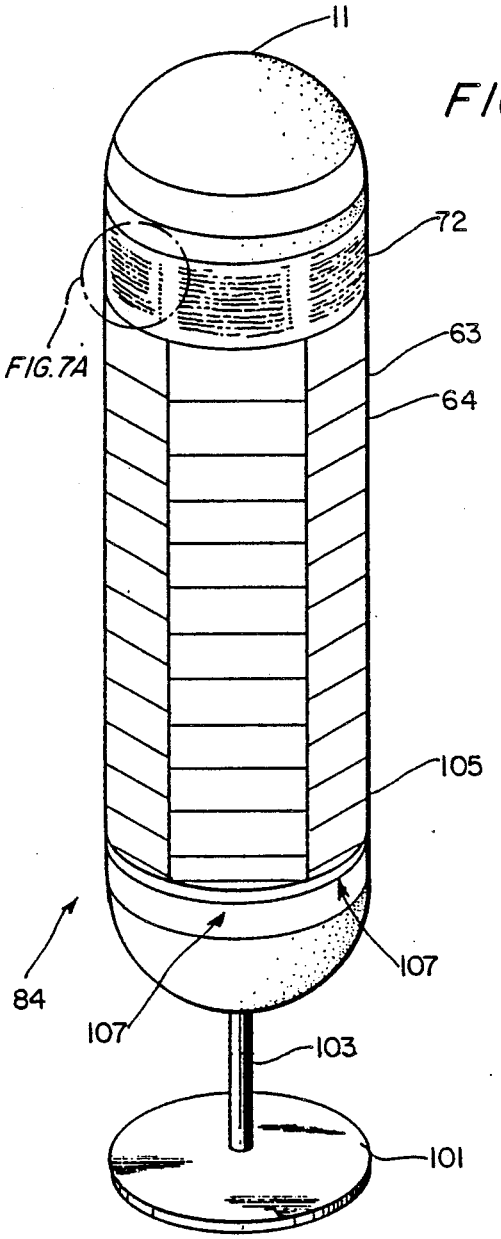
FIG. 7 shows the unique revolving floor display used to hold a plurality of different drug information cards in addition to backup card inventory. Also shown in FIG. 7 is an enlarged section of a unique index used to facilitate easy and quick location of any card on the display.

FIG. 7 depicts a unique capsule-shaped revolving floor display 84. Supported on a round plastic or metal planar base 101 with a single vertical metal support 103, this display rack is fabricated of plastic and rotates around a single center axis. In a preferred embodiment, the display has eight rows 107 of card storage pockets 105 of equal width, each pocket capable of holding 12 drug information cards. It is contemplated that there could be more or less rows and each individual pocket could hold more or less cards. Each row contains 12 separate pockets 105 for drug information cards, but there could be more or less pockets. Only the top of the card in each storage pocket would be visible to the eye when a user of this invention views the display. The storage pockets are of such depth that only the top information band 40 of each card displayed in the rack and the drug name 42 for each card would be visible when looking at the display. All cards are viewable when the display is rotated about its vertical support.

This rotating card display 11 has as an integral design feature an index 72 by which a user of this invention can easily and quickly locate any card on the display. A magnified section of this index 73 illustrates an alphabetical listing of all drug names, both brand and generic, of drug information cards contained on this rack. After each drug name listing in the index 72, a number is shown 73 which is unique to each card. This number is the same for all brand and generic names of the same drug.

Further variations on the inventive concept are possible, and will now be apparent to persons skilled in the art. Reference should be made to the appended claims rather than the foregoing specifications as indicating the true scope of the subject invention.

What is claimed is:

1. A system for conveying information to consumers of prescription drugs, said system comprising:

an information card having a plurality of pages including a front page;

said front page having information printed thereon, said information including an information band across the top of the front page, said information band including a unique index identification symbol for identifying a drug the name of which also appears on said front page;

a plurality of drug information sections each section including a unique identification icon and descriptive text, said icon providing the consumer with a quick identification of the type of information found in the description text that is positioned next to the icon, said drug information sections being arranged next to each other down the length of the front page;

at least one of said plurality of pages defining a consumer interaction page, said consumer page including a plurality of drug awareness sections, each section including a unique identification icon and descriptive text, said icon providing the consumer with a quick identification of the type of information found in the descriptive text that is positioned next to the icon, said descriptive text including a series of statements about said drug and box adjacent each statement, said box providing an identification block for the consumer to mark and create a permanent record on said consumer page of the relevance of said statements; and at least one of said plurality of pages defining a drug instruction page, said instruction page including a plurality of drug instruction sections, each section including a unique identification icon and descriptive text, said icon providing the consumer with a quick identification of the type of information found in the descriptive text that is positioned next to the icon, said descriptive text providing instructions concerning the drug listed on the information band.

2. The system of claim 1, wherein said identification symbol is a number.

3. The system of claim 1, wherein said unique identification icon is in the form of a characterization of a human with the head of a pill and said type of information includes a drug's band name, generic name and uses.

4. The system of claim 1, wherein said statements comprise statements relating to a drug's side effects.

5. The system of claim 1, wherein said statements comprise a list of medications.

6. The system of claim 1, wherein said statements comprise a list of precautions.

7. The system of claim 1, wherein said drug instruction sections comprise food interactions, user precautions, dosage, and storage information.

* * * * *